US011484170B2

(12) United States Patent
Arnold et al.

(10) Patent No.: US 11,484,170 B2
(45) Date of Patent: Nov. 1, 2022

(54) SYSTEM CONSISTING OF FLOOR TREATMENT APPARATUS THAT IS EXCLUSIVELY GUIDED MANUALLY AND A FLOOR TREATMENT APPARATUS THAT IS EXCLUSIVELY OPERATED AUTOMATICALLY, AS WELL AS METHOD FOR OPERATING A SYSTEM OF THIS TYPE

(71) Applicant: Vorwerk & Co. Interholding GmbH, Wuppertal (DE)

(72) Inventors: Hans-Peter Arnold, Kierspe (DE); Thomas Buening, Bochum (DE); Benjamin Fleczok, Essen (DE); Robert Frielinghaus, Bochum (DE); Martin Helmich, Duisburg (DE); Lorenz Hillen, Wuppertal (DE); Christian Holz, Dortmund (DE); Gerhard Isenberg, Cologne (DE); Andrej Mosebach, Bochum (DE); Roman Ortmann, Duisburg (DE); Kevin Schmitz, Duesseldorf (DE); Fabian Vitz, Wuppertal (DE); Niklas Van Teeffelen, Duesseldorf (DE); Uwe Kemker, Wuppertal (DE); Georg Hackert, Wilen bei Wollerau (CH)

(73) Assignee: VORWERK & CO. INTERHOLDING GMBH, Wuppertal (DE)

( * ) Notice: Subject to any disclaimer, the term of this patent is extended or adjusted under 35 U.S.C. 154(b) by 547 days.

(21) Appl. No.: 16/741,866

(22) Filed: Jan. 14, 2020

(65) Prior Publication Data

US 2020/0229669 A1 Jul. 23, 2020

(30) Foreign Application Priority Data

Jan. 18, 2019 (DE) ..... 10 2019 101 338.0

(51) Int. Cl.
*A47L 9/28* (2006.01)
*A47L 7/00* (2006.01)
(Continued)

(52) U.S. Cl.
CPC ..... *A47L 9/2894* (2013.01); *A47L 7/0004* (2013.01); *A47L 9/009* (2013.01); *A47L 9/281* (2013.01);
(Continued)

(58) Field of Classification Search
None
See application file for complete search history.

(56) References Cited

U.S. PATENT DOCUMENTS

2018/0344114 A1* 12/2018 Scholten ..... G05D 1/0291
2018/0360282 A1* 12/2018 Erkek ..... A47L 9/2847
(Continued)

FOREIGN PATENT DOCUMENTS

EP 2 294 960 B1 12/2015
WO 2015/178855 A1 11/2015

*Primary Examiner* — Mikhail Kornakov
*Assistant Examiner* — Pradhuman Parihar
(74) *Attorney, Agent, or Firm* — Collard & Roe, P.C.

(57) ABSTRACT

The invention pertains to a system consisting of a first floor treatment apparatus that is exclusively guided manually within an environment by a user and a second floor treatment apparatus that is exclusively operated automatically, wherein the second floor treatment apparatus is designed for orienting and localizing itself within an environment. The first floor treatment apparatus is designed for detecting a movement path of the first floor treatment apparatus during a movement of the first floor treatment apparatus that is manually guided by a user, as well as for transmitting information on the detected movement path to the second floor treatment apparatus by means of wireless communication. The second floor treatment apparatus is designed for
(Continued)

receiving the information and for autonomously traveling along the movement path within the environment based on the received information.

12 Claims, 6 Drawing Sheets

(51) Int. Cl.
*A47L 9/00* (2006.01)
*A47L 11/28* (2006.01)
*A47L 11/40* (2006.01)

(52) U.S. Cl.
CPC ..... *A47L 9/2826* (2013.01); *A47L 9/2831* (2013.01); *A47L 9/2847* (2013.01); *A47L 9/2852* (2013.01); *A47L 11/28* (2013.01); *A47L 11/4066* (2013.01); *A47L 11/4011* (2013.01); *A47L 11/4061* (2013.01); *A47L 2201/04* (2013.01); *A47L 2201/06* (2013.01)

(56) References Cited

U.S. PATENT DOCUMENTS

| | | | | |
|---|---|---|---|---|
| 2018/0361569 | A1* | 12/2018 | Hackert | A01B 79/00 |
| 2019/0320866 | A1* | 10/2019 | Thorne | B25J 11/0085 |
| 2020/0049514 | A1 | 2/2020 | Grandl | |

* cited by examiner

SYSTEM CONSISTING OF FLOOR TREATMENT APPARATUS THAT IS EXCLUSIVELY GUIDED MANUALLY AND A FLOOR TREATMENT APPARATUS THAT IS EXCLUSIVELY OPERATED AUTOMATICALLY, AS WELL AS METHOD FOR OPERATING A SYSTEM OF THIS TYPE

TECHNICAL FIELD

The invention pertains to a system consisting of a first floor treatment apparatus that is exclusively guided manually within an environment by a user and a second floor treatment apparatus that is exclusively operated automatically, wherein the second floor treatment apparatus is designed for orienting and localizing itself within an environment.

The invention furthermore pertains to a method for operating a system of this type, wherein a first floor treatment apparatus is exclusively guided manually within an environment by a user, wherein a second floor treatment apparatus is exclusively operated automatically, and wherein the second floor treatment apparatus orients and localizes itself within an environment.

PRIOR ART

Floor treatment apparatuses that are manually guided by a user and floor treatment apparatuses that are exclusively operated automatically are sufficiently known from the prior art. It is furthermore known to operate a system consisting of two such floor treatment apparatuses, for example within a household, and to utilize the advantages of the manually guided floor treatment and the automatically operated floor treatment in a supplementary manner.

Floor treatment apparatuses in the sense of the invention may consist, for example, of cleaning apparatuses such as vacuum cleaners and/or wet-mopping apparatuses, polishing apparatuses, burnishing apparatuses, grinding apparatuses, lawnmowers or the like. In this case, floor treatment apparatuses that are manually guided by a user usually are characterized by a shaft and/or handle, on which the user can guide the floor treatment apparatus over a surface to be treated such as a floor surface or above-floor surface. Automatically operated floor treatment apparatuses are characterized by a navigation device for the automatic orientation and localization within an environment, preferably based on an environment map, wherein the automatic floor treatment apparatus can automatically travel within the environment, navigate based on the environment map and in the process optionally carry out floor treatment activities.

For example, patent EP 2 294 960 B1 discloses a cleaning robot that is designed for recording premises in the form of a map and for traveling on the floor of one or more rooms, wherein the cleaning robot is equipped with sensor means for determining the positions of obstacles within a recorded room. In this case, an environment map or environment data can be recorded during an exploratory run. The exploratory run is either controlled by the floor treatment apparatus itself or manually by a user during the course of a so-called teach-in, in which the user manually steers the cleaning apparatus through the environment, for example by means of a remote control. In this context, it is also known to input surface boundaries and/or to define so-called no-go areas, within which the cleaning robot is not allowed to travel, for example by means of an instructive run through the environment.

According to publication WO 2015/178855 A1, it is furthermore known to equip a manually guided floor treatment apparatus with a device that can operate in a learning mode and an automatic mode, wherein the device records movements and activities of the manually guided floor treatment apparatus during the learning mode and controls the same or another floor treatment apparatus during the automatic mode in such a way that the previously recorded movements and activities are carried out anew by the respective floor treatment apparatus.

SUMMARY OF THE INVENTION

Based on the aforementioned prior art, the invention aims to advantageously link a manually guided floor treatment apparatus and an automatically operated floor treatment apparatus and to additionally optimize the behavior of the floor treatment apparatuses linked in the system.

In order to attain the above-defined objective with respect to the system, it is proposed that the first floor treatment apparatus is designed for detecting a movement path of the first floor treatment apparatus during a movement of the first floor treatment apparatus that is manually guided by a user, as well as for transmitting information on the detected movement path to the second floor treatment apparatus by means of wireless communication, wherein the second floor treatment apparatus is designed for receiving the information and for autonomously traveling along the movement path within the environment based on the received information.

According to the invention, the manually guided floor treatment apparatus and the automatically operated floor treatment apparatus, as well as optionally other manually or automatically operated floor treatment apparatuses of the system, are linked to one another in such a way that the floor treatment apparatus, which is manually guided by a user, provides a so-called teach-in for at least one automatically operated floor treatment apparatus. The floor treatment apparatuses are designed in such a way that the manually guided floor treatment apparatus records a movement characteristic of a movement of the first floor treatment apparatus and subsequently transmits the data containing the movement characteristic to an automatically traveling floor treatment apparatus such that the movement characteristic including the movement path can be used as a template for the movement of the automatic floor treatment apparatus. The floor treatment apparatus that is exclusively operated automatically, i.e. the floor treatment robot, can subsequently retrace the movement path of the floor treatment apparatus that is manually guided by the user. In this way, the autonomous floor treatment apparatus also travels within the environment in exactly the same way as defined previously by the user with the manually guided first floor treatment apparatus. The movement path can be retraced identically as long as the second floor treatment apparatus can also access the sections of the environment, which the first floor treatment apparatus has previously accessed with the aid of the user. Different apparatuses or types of apparatuses are thereby interlinked in order to achieve an at least semi-automatic behavioral optimization of the overall system. The evaluation of the movement path detected by the first floor treatment apparatus may advantageously take place directly within the first floor treatment apparatus, wherein an evaluation device of the first floor treatment apparatus evaluates the sensor data of one or more sensors of the first floor treatment apparatus and processes said sensor data into information on the detected movement path.

The result of the evaluation is then transmitted to the second floor treatment apparatus in the form of information, e.g. sent to or retrieved by this second floor treatment apparatus. It is alternatively also possible that the information of the first floor treatment apparatus on the detected movement path contains the raw or only partially processed sensor data of the first floor treatment apparatus, wherein the evaluation of this sensor data does not take place in the first floor treatment apparatus in this case, but rather within the second floor treatment apparatus and/or in a separate computing device such as a base station for the first and/or second floor treatment apparatus and/or within an external server such as a cloud. If the evaluation does not take place within the second floor treatment apparatus, the results of the evaluation can be subsequently transmitted to the second floor treatment apparatus. It is furthermore also possible, for example, that certain sensor data is not transmitted to the second floor treatment apparatus, but rather to other robots connected to the system such as monitoring robots or service robots, which do not carry out any floor treatment activity.

It is furthermore proposed that the first floor treatment apparatus is designed for detecting a floor treatment activity carried out by the first floor treatment apparatus during a user-guided movement of the first floor treatment apparatus, as well as for transmitting information on the floor treatment activity to the second floor treatment apparatus by means of wireless communication, wherein the second floor treatment apparatus is designed for receiving the information and for automatically carrying out the floor treatment activity. In addition to the movement path, the first floor treatment apparatus therefore also detects one or more floor treatment activities carried out by the first floor treatment apparatus along the movement path. This at least one floor treatment activity is then transmitted to the second floor treatment apparatus in the form of information such that this second floor treatment apparatus can repeat the same floor treatment activity. In this way, the teach-in for the automatically operated second floor treatment apparatus not only contains a movement path to be followed through the environment, but rather also floor treatment activities to be carried out automatically. All in all, the system with the first floor treatment apparatus and the second floor treatment apparatus is then designed in such a way that the user utilizes the manually guided floor treatment apparatus for recording a movement trajectory, as well as for recording floor treatment activities that are initiated by the user and can subsequently be repeated in a fully automated manner by means of a control device of the second floor treatment apparatus after the transmission of the corresponding information to the second floor treatment apparatus. In this way, a user can teach the second floor treatment apparatus that or how certain sections of the environment should be respectively treated or not treated.

It is proposed that the first floor treatment apparatus and the second floor treatment apparatus have corresponding communication modules for wireless communication of the information on the movement path and/or the floor treatment activity. The floor treatment apparatuses particularly may be equipped with corresponding WLAN modules, Bluetooth modules or other radio modules that are suitable for transmitting the information on the movement path and/or the floor treatment activity. It is therefore not required to physically connect sections of the first and the second floor treatment apparatus to one another or to transfer a memory containing the information from the first floor treatment apparatus to the second floor treatment apparatus. In fact, it suffices to transmit at least the information on the movement path, i.e. at least the sensor signals of a corresponding detection device of the first floor treatment apparatus, to the second floor treatment apparatus. This may be realized, for example, in the form of a message sent by the first floor treatment apparatus or by the second floor treatment apparatus accessing information on the movement path or the floor treatment activity, which is stored in the first floor treatment apparatus.

It is furthermore proposed that the first floor treatment apparatus has a detection device that comprises at least one device of the following group: a camera, a laser scanner, a floor sensor for detecting the type of surface to be treated, a dirt sensor for detecting the type or degree of a dirt accumulation on the surface to be treated, a sensor for determining the power of a driving motor, a distance sensor, an inertial sensor, a time sensor and/or a contact sensor. One or more of the aforementioned devices are designed for recording detection signals that can be processed into information for the second floor treatment apparatus. The first floor treatment apparatus and/or the second floor treatment apparatus accordingly may have an evaluation device that is designed for determining at least one of the following types of information from the detection signals of the detection device: a movement path of the first floor treatment apparatus in the environment, an environment map, a treatment status of a section of the environment, a position of a treated section, an untreated section and/or a section that is not accessible to the first floor treatment apparatus, a floor type, a type of dirt accumulation, a degree of dirt accumulation, an accessory suitable for use by the first floor treatment apparatus for floor treatment purposes, 3D environment information and/or obstacle information. For example, the camera and/or the laser scanner serve for determining the position of the first floor treatment apparatus within the environment, as well as for determining the position of obstacles. A so-called SLAM (Simultaneous Localization And Measurement) algorithm typically can be used for this purpose. A movement path of the manually guided floor treatment apparatus in the environment can be detected with the sensor data of the respective camera or laser scanner. Furthermore, an environment map for the manually guided and/or the automatically operated second floor treatment apparatus can be generated based on the sensor data, wherein said environment map shows treated sections and untreated sections of the environment, i.e. sections that were omitted and/or not accessible during the floor treatment activity, optionally including information on the number of repetitions carried out or attempted by the manually guided floor treatment apparatus in order to complete the floor treatment activity. The manually guided floor treatment apparatus may furthermore have a floor sensor for detecting a floor type. Such a floor sensor may comprise, for example, a camera or a sensor for determining a power of a driving motor. It would be possible to detect, for example, the power consumption of a motor that serves for driving a fan motor, a driving wheel, a rotating cleaning roller, an oscillating mopping element or the like. For example, a rotating bristle roller of the manually guided floor treatment apparatus requires a higher power consumption of the driving motor on a carpeted floor or a carpet than on a hard floor such as tiles or wooden floorboards. This makes it possible to deduce the type of floor. A dirt sensor of the floor treatment apparatus for detecting the type and/or degree of a dirt accumulation on the surface to be treated may likewise comprise a camera. If the manually guided floor treatment apparatus is equipped with distance sensors such as infrared sensors and/or ultrasonic sensors, these sensors serve for measuring the distance from obstacles present within the environment. On the one hand, this makes it possible to prevent the first floor treatment apparatus and subsequently also the second floor treatment apparatus from bumping against a room boundary and/or an object within the environment. The apparatus preferably can maintain a certain safety clearance from the obstacle or approach this obstacle very slowly. On the other hand, the information on an obstacle can also be used for detecting movable interfering items or interfering objects such as cables, pedestals, vases, flowers, children's toys or the like within the environment and, for example, for prompting a user to remove these items or objects from the section of the environment to be treated. A complementary camera can optionally be used for carrying out object detection by means of digital image processing. The manually guided floor treatment apparatus may furthermore have a device for detecting a certain accessory connected to the floor treatment apparatus, particularly an attachment. For example, such an accessory may be a certain floor treatment element or a removable attachment. A floor treatment element may be realized, for example, in the form of a cleaning element such as a bristle roller, a mopping element or the like. The accessory may carry a code that positively identifies the accessory, wherein the manually guided floor treatment apparatus has a corresponding detection device that is designed for detecting this code and for accordingly distinguishing the detected accessory from another accessory. Consequently, the information transmitted from the manually guided floor treatment apparatus to the automatically traveling floor treatment apparatus may also indicate which accessory was used for the floor treatment activity such that the automatically operated floor treatment apparatus can also respectively operate or be equipped with a corresponding accessory. In this case, it is particularly advantageous that it can also be taken into account whether the floor treatment apparatus is equipped for treating hard floor surfaces or carpeted floors or carpets. For example, if the manually guided floor treatment apparatus furthermore has an inertial sensor, it is also possible, among other things, to follow a three-dimensional movement path of this floor treatment apparatus within the environment. An inertial sensor may be realized, for example, in the form of a gyroscope. This makes it possible to obtain 3D information that contains, for example, treated floors of a building, steps of a stairway and/or above-floor surfaces of a room such as window sills, surfaces of pieces of furniture or the like. Furthermore, a time sensor of the manually guided floor treatment apparatus can deliver information on the time span, within which the user has carried out a floor treatment activity or multiple floor treatment activities by means of the manually guided floor treatment apparatus. The time history and/or a speed of the floor treatment can thereby be recorded. In addition, corresponding sensor data can be associated with different points in time. In this way, the time history of the floor treatment can be matched and synchronized with detected sensor data of the detection device of the floor treatment apparatus. This time history of the floor treatment can then be accordingly reproduced by the automatically operated floor treatment apparatus such that, for example, a certain time span is used for certain floor treatment activities and/or the automatically operated floor treatment apparatus travels within the environment exactly as fast as the user has previously moved the manually guided floor treatment apparatus. Furthermore, a contact sensor provided on the manually guided floor treatment apparatus may serve, for example, for marking a certain point in time and/or location of the environment during the floor treatment by the user. For example, the contact sensor may be actuated by means of an actuation element. The actuation particularly can register different characteristics such as a brief depression, a long depression or multiple actuations, each of which characterizes different events. The actuation element may be realized in the form of a pushbutton or the like.

In this context, it is proposed that the first floor treatment apparatus has an actuation element that can be actuated by a user and enables the user to mark sections of the environment stored in an environment map and/or positions of the movement path during a movement of the first floor treatment apparatus and/or during a floor treatment activity. The teach-in provided by the manually guided floor treatment apparatus, i.e. the training of the automatically operated second floor treatment apparatus, therefore can indicate particular locations within the environment that require a special treatment and/or reaction by the second floor treatment apparatus. For example, this special treatment and/or reaction differ from the floor treatment of the manually guided floor treatment apparatus at this location.

In this context, it is proposed that the first floor treatment apparatus is designed for transmitting information on the marked sections and/or positions to the second floor treatment apparatus, wherein the second floor treatment apparatus has a control and evaluation device that is designed for controlling a defined floor treatment activity of the second floor treatment apparatus within the marked section and/or at the marked position or for avoiding the section or the position as a no-go area during a floor treatment activity. The term no-go area describes a region, in which the automatically operated second floor treatment apparatus is not allowed to travel. The information on a defined no-go area preferably can be transmitted from the manually guided floor treatment apparatus to the automatically operated floor treatment apparatus. The control and evaluation device of the second floor treatment apparatus evaluates the information of the manually guided floor treatment apparatus and defines, for example, a correspondingly modified movement path and/or a modified floor treatment activity to be carried out by the automatically operated floor treatment apparatus, particularly differently from the manually operated floor treatment apparatus.

It is therefore particularly proposed that the floor treatment activity of the second floor treatment apparatus defined for the marked section and/or the marked position differs from the floor treatment activity carried out by the first floor treatment apparatus in this section or at this position. For example, the defined floor treatment activity of the second floor treatment apparatus may comprise intensive cleaning or gentle cleaning of the marked section or the marked position. The control device of the automatically operated floor treatment apparatus therefore may be designed for carrying out particularly gentle or particularly intensive cleaning of a section or a position by means of the automatic floor treatment apparatus in reaction to corresponding information concerning this marked section and/or marked position. In this case, the automatically operated floor treatment apparatus can travel to the marked section or the marked position and carry out a special cleaning operation at this location, which the user has marked by actuating the actuation element. A special cleaning operation may consist, for example, of gentle cleaning of the respective location with a low cleaning power, a slow rotational speed of the cleaning element or by means of wet and/or dry cleaning. Furthermore, a special cleaning agent may be provided for the special cleaning operation. Alternatively, intensive cleaning may be defined for a marked section or a marked position in order to treat particularly treatment-intensive regions of the environment such as stubbornly soiled regions, which were pre-cleaned by the manually guided floor treatment apparatus. In this case, the information for the automatically operated floor treatment apparatus may also contain information on that the automatically operated floor treatment apparatus has to travel over the location to be treated multiple times in different directions and/or with certain parameters of a defined floor treatment accessory. In this context, the automatically operated second floor treatment apparatus can be operated differently from the manually guided first floor treatment apparatus in order to achieve a floor treatment result, which could previously not be realized by means of the manually guided floor treatment apparatus. The defined floor treatment activity of the second floor treatment apparatus may comprise other measures that are selected from the following group: adapting a suction power of the floor treatment apparatus to environmental conditions such as increasing a suction power for cleaning carpeted floors, increasing a suction power for cleaning severely soiled sections or floor surfaces or reducing a suction power in order to save energy, particularly on hard floors or slightly soiled sections, deactivating a cleaning device in sections that were recently cleaned by a manually guided floor treatment apparatus, adapting the rotational speed of a cleaning element such as a brush, adapting a brush rotating direction, particularly for preventing carpet fringes from being sucked in, brushing away dirt accumulations that could not be removed by the manually guided floor treatment apparatus, adapting a moving speed, for example, in order to move faster across recently traveled sections of the environment or to move slowly over relatively severely soiled sections and/or over regions of the environment that contain obstacles such as multiple table or chair legs, a decision on wet or dry cleaning, wherein the floor treatment activity may also be split between wet cleaning apparatuses and dry-cleaning apparatuses in multi-robot systems, carrying out wet cleaning only in sections, in which a user has previously used a manually guided vacuum cleaning apparatus, as well as avoiding sections, in which a user has so far never used a manually guided floor treatment apparatus.

It is furthermore proposed that the second floor treatment apparatus is designed for transmitting information concerning the environment to the first floor treatment apparatus after the second floor treatment apparatus has traveled along the movement path and/or after the second floor treatment apparatus has carried out the floor treatment activity, wherein said information is selected from the following group: an environment map of the environment generated by the second floor treatment apparatus, a section of the environment and/or a position of the movement path to be cleaned manually by the first floor treatment apparatus, as well as a section and/or a position that contains a movable obstacle to be removed by the user. According to this embodiment, the automatically operated second floor treatment apparatus transmits information to the manually guided floor treatment apparatus, wherein said information can be used for the floor treatment activities of the manually guided floor treatment apparatus. To this end, it is particularly preferred that the first floor treatment apparatus has a display unit for displaying the information transmitted by the second floor treatment apparatus. A display unit may be provided, for example, on a handle of the manually guided floor treatment apparatus, wherein the location, at which a manual floor treatment should be carried out by means of the manually guided floor treatment apparatus, is displayed to the user on said display unit. Furthermore, an environment map may be displayed to the user on this display unit. This is particularly advantageous because a manually guided floor treatment apparatus usually does not have a device for generating an environment map. Since the automatically operated second floor treatment apparatus generates an environment map anyway in order to navigate and self-localize within the environment, this environment map is advantageously also made available to the manually guided floor treatment apparatus and the user in order to display the respective location of the environment requiring special floor treatment, the respective location containing a movable obstacle to be removed or the respective section of the environment and/or position of the movement path, in/through which the manually guided floor treatment apparatus is not allowed to travel, to the user in a particularly simple and illustrative manner. This embodiment makes it possible to display the respective location, at which manual secondary cleaning should be carried out due to severe or stubborn dirt accumulation, to the user of the manually guided floor treatment apparatus, alternatively also via an external terminal with a corresponding application, which is communicatively linked to the manually guided floor treatment apparatus. Manual secondary cleaning by means of the manually guided floor treatment apparatus may also be required, for example, due to the fact that the floor treatment robot was unable to travel in certain sections of the environment because they were not accessible or contained movable obstacles or due to the fact that an accumulator of the floor treatment apparatus was drained. For example, the automatically operated floor treatment apparatus detects during its automatic movement an increased power consumption of a motor driving a cleaning element by means of a corresponding detection device. This makes it possible to deduce a change of the floor type, optionally with the assistance of an additional floor type sensor comprising a camera. Such sections of the environment can be suggested to a user of the system for manual treatment by means of the manually guided floor treatment apparatus. This is realized, for example, in that information is output to the user as soon as the manually guided floor treatment apparatus approaches a defined section. For example, floor treatment parameters may be suggested and/or automatically adjusted in this case. In this context, it would also be possible that the manually guided first floor treatment apparatus is likewise designed for localizing itself within an environment map of the automatically operated floor treatment apparatus. To this end, the manually guided floor treatment apparatus may optionally also be equipped with sensors that allow at least a rough localization in the environment, but not the generation of an individual environment map. The manually guided floor treatment apparatus preferably can at least update, expand and/or supplement an environment map of the automatically operated floor treatment apparatus. In this context, it would be conceivable to supplement information, for example, on above-floor surfaces that are not accessible to the automatically operated floor treatment apparatus. It is likewise possible to once again transmit the modified environment map back from the manually guided floor treatment apparatus to the automatically operated floor treatment apparatus.

In addition to the above-described system consisting of a first floor treatment apparatus that is exclusively guided manually by a user and a second floor treatment apparatus that is exclusively operated automatically, the invention furthermore proposes a method for operating a system of this type, wherein a first floor treatment apparatus is exclusively guided manually within an environment by a user, wherein a second floor treatment apparatus is exclusively operated automatically, wherein the second floor treatment apparatus orients and localizes itself within an environment, wherein the first floor treatment apparatus furthermore detects a movement path of the first floor treatment apparatus during a movement of the first floor treatment apparatus that is manually guided by a user and transmits information on the detected movement path to the second floor treatment apparatus by means of wireless communication, and wherein the second floor treatment apparatus receives the information and autonomously travels along the movement path within the environment based on the received information, and/or wherein the first floor treatment apparatus detects a floor treatment activity carried out by the first floor treatment apparatus during a movement of the first floor treatment apparatus and transmits information on the floor treatment activity to the second floor treatment apparatus by means of wireless communication, and wherein the second floor treatment apparatus receives the information and automatically carries out the floor treatment activity.

The characteristics and advantages described above with reference to the inventive system also apply accordingly to the inventive method for operating an inventive system. In order to avoid repetitions, we correspondingly refer to the preceding explanations.

BRIEF DESCRIPTION OF THE DRAWINGS

The invention is described in greater detail below with reference to exemplary embodiments. In the drawings.

DESCRIPTION OF THE EMBODIMENTS

Figure 1:
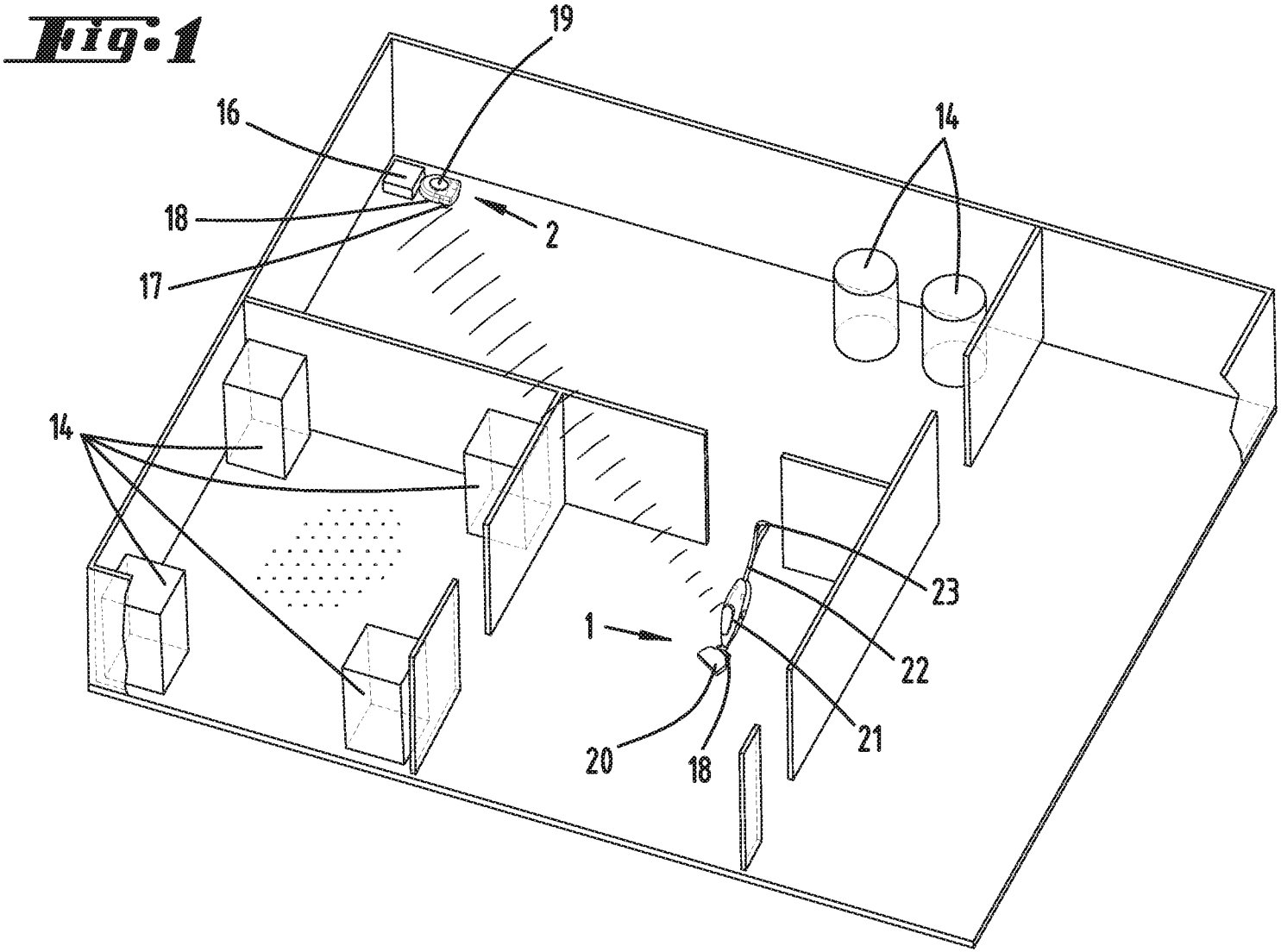
FIG. 1 shows an environment with a system consisting of a first floor treatment apparatus and a second floor treatment apparatus.
Figure 2:
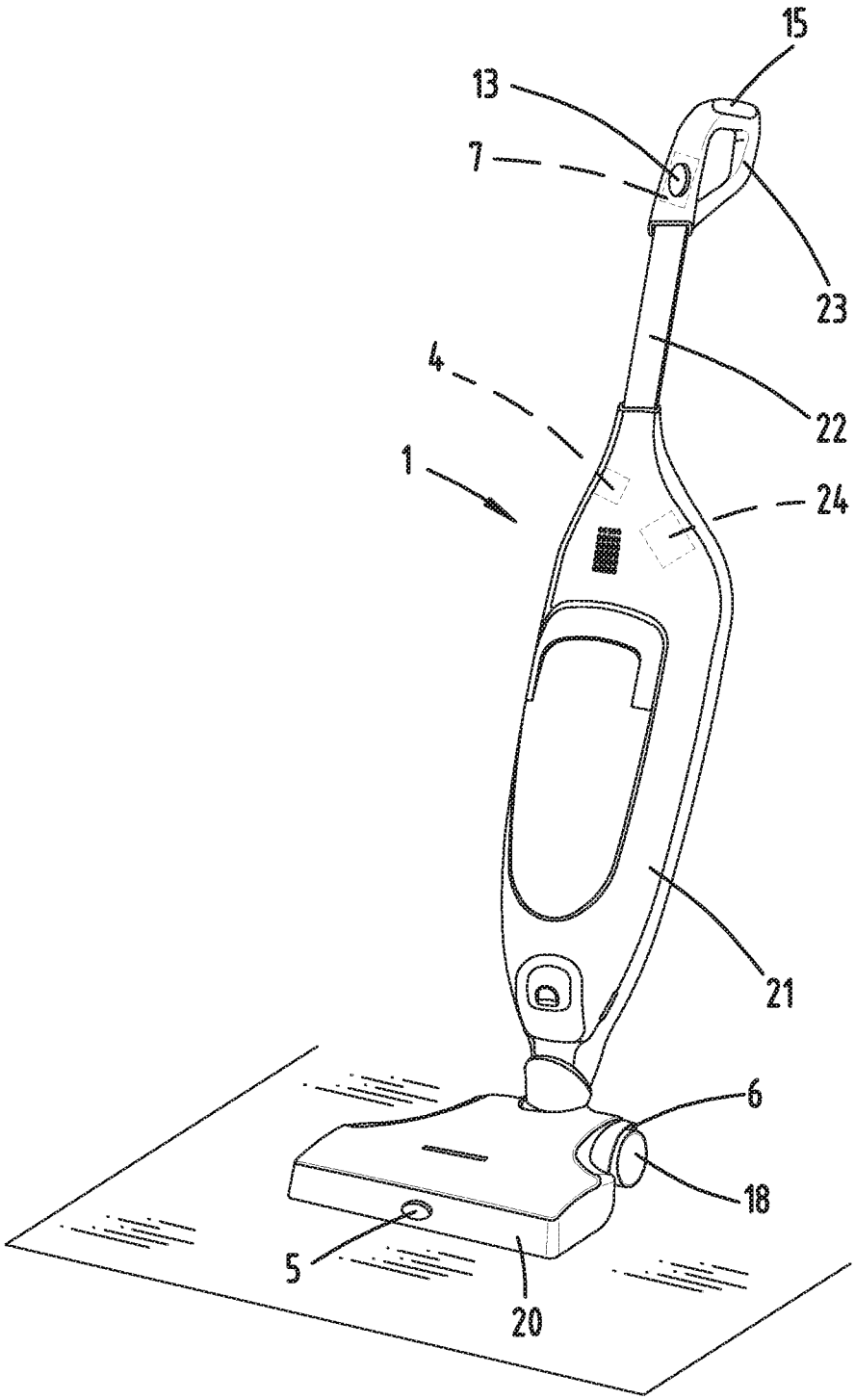
FIG. 2 shows an enlarged view of the first floor treatment apparatus.

FIG. 1 schematically shows a floor plan of a residence with multiple rooms. An inventive system, which consists of a first floor treatment apparatus 1 that is exclusively guided manually by a user and a second floor treatment apparatus 1 that is exclusively operated automatically, is located in the residence. In this example, the first floor treatment apparatus 1 is a hand-operated vacuum cleaner, which is described in greater detail with reference to FIG. 2. The automatically operated floor treatment apparatus 2 is in this example a vacuuming robot, which is described in greater detail with reference to FIG. 3. The environment of the floor treatment apparatuses 1, 2 comprises conventional room boundaries such as walls and obstacles 14, which may or may not be movable by a user. Examples of obstacles 14 that can be easily removed by a user are flower pots, vases, small pieces of furniture or the like. Obstacles 14 that cannot be readily moved or removed include, for example, heavy pieces of furniture, pianos, large loudspeakers or the like. A base station 16 for the automatically operated second floor treatment apparatus 2 is located in the environment. This base station 16 has devices and means for carrying out service activities on the automatically operated second floor treatment apparatus 2 or optionally also on other floor treatment apparatuses 1, 2. Such service activities include, for example, charging an accumulator of a floor treatment apparatus 1, 2, emptying a dust collection bin of a floor treatment apparatus 1, 2, cleaning a floor treatment element 17 of a floor treatment apparatus 1, 2 or the like.

The floor treatment apparatuses 1, 2 are now described in greater detail. According to FIGS. 1 and 2, the floor treatment apparatus 1 being manually guided by a user has a base unit 21, as well as a floor nozzle 20 that is separably connected to the base unit 21. In this example, the floor nozzle 20 is a vacuum nozzle with a not-shown cleaning brush that forms a floor treatment element 17. The floor nozzle 20 has wheels 18 in order to move the floor treatment apparatus 1 as a whole over a floor to be cleaned with little resistance. To this end, the wheels 18 or also the floor treatment element 17 may be driven by a motor in order to assist in the movement of the floor treatment apparatus 1 and to simplify the handling of the floor treatment apparatus 1 for a user. The base unit 21 has a shaft 22 with a handle 23. A not-shown switch may be provided on the handle 23 in order to enable a user to activate and deactivate the floor treatment apparatus 1, as well as to optionally adjust different power stages or the like. In this case, the handle 23 is furthermore equipped with an actuation element 13 that is functionally connected to a detection device 7, namely a contact sensor. The actuation element 13 can be depressed by a user such that the contact sensor registers a corresponding contact signal. The function of the actuation element 13 and the contact sensor is described in greater detail below. Furthermore, a display unit 15 for displaying information to a user of the floor treatment apparatus 1 is located on the handle 23 or alternatively on the shaft 22. The floor treatment apparatus 1 has other detection devices 5, 6, which include a camera (reference symbol 5) arranged on the floor nozzle 20. An additional detection device 6 in the form of an inertial sensor is also associated with the wheels 18 of the floor nozzle 20. The camera records images of the environment that contain, for example, the obstacles 14 on the one hand and the floor surface to be cleaned on the other hand. The inertial sensor detects the wheel revolutions of the wheels 18 such that it is possible to deduce a distance traveled by the floor treatment apparatus and a change of direction of the floor treatment apparatus 1 during its movement through the environment. The base unit 21 of the floor treatment apparatus 1 is furthermore equipped with a computing device 24 that is designed for at least partially processing the signals of the detection devices 5, 6, 7 in such a way that information on the detection signals of the detection devices 5, 6, 7 can be compiled and then transmitted to the second floor treatment apparatus 2 of the system by means of a communication module 4 of the floor treatment apparatus 1. In this example, the communication module 4 is a WLAN module that allows wireless communication between the floor treatment apparatuses 1, 2 of the system.

Figure 3:
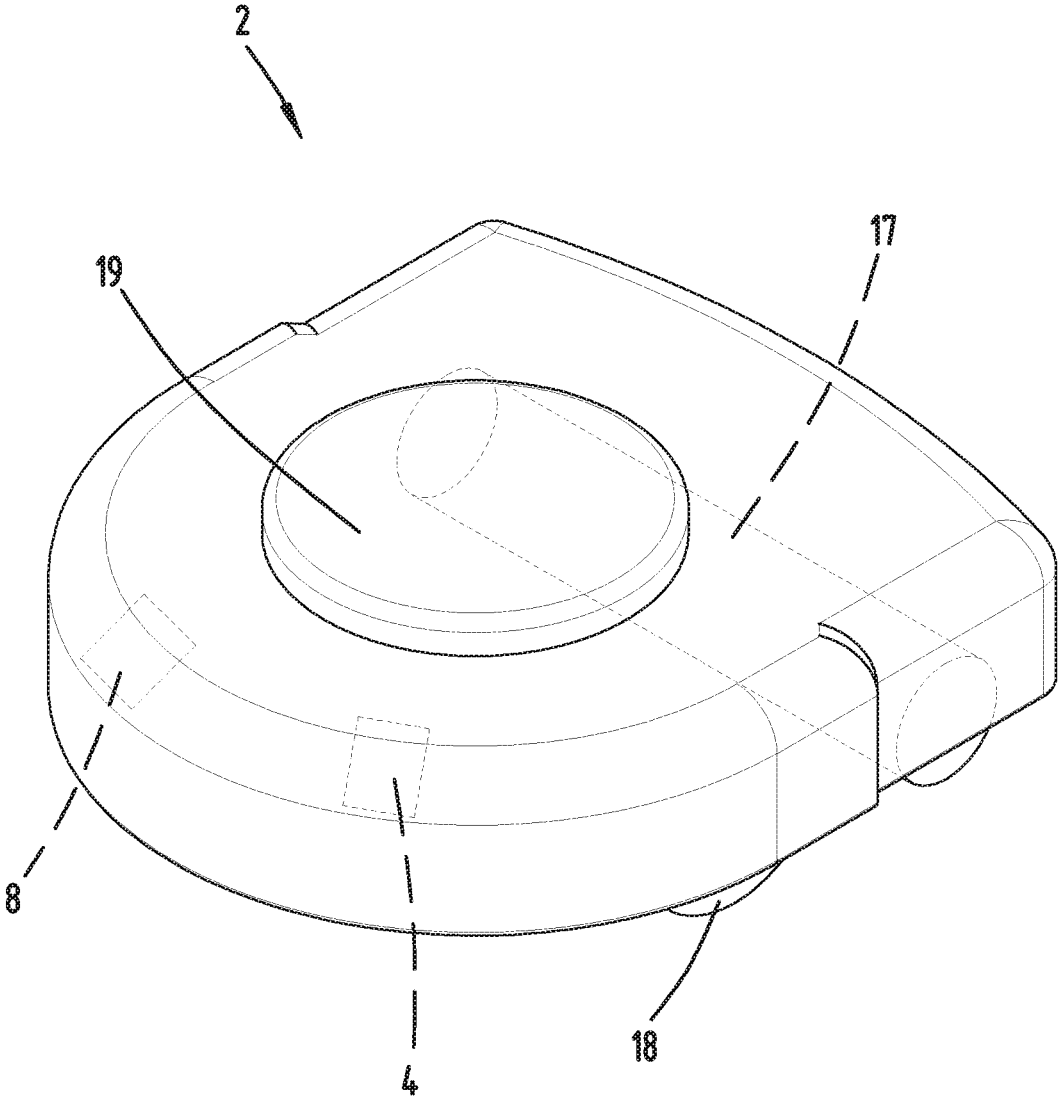
FIG. 3 shows an enlarged view of the second floor treatment apparatus.
Figure 5:
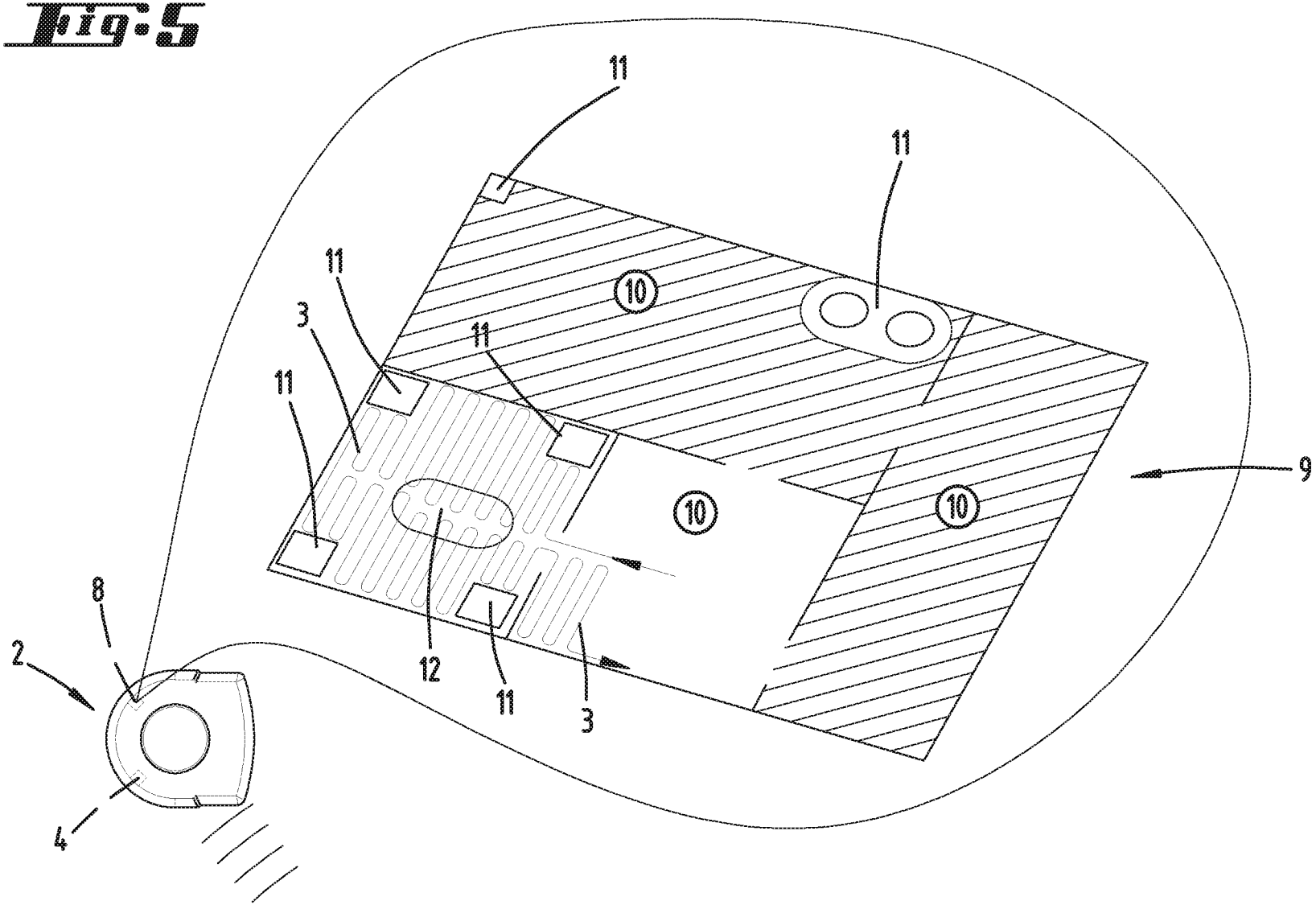
FIG. 5 shows the second floor treatment apparatus with an environment map.

The automatically operated second floor treatment apparatus 2 illustrated in FIG. 3 has motor-driven wheels 18, as well as a floor treatment element 17 that in this example is realized in the form of a rotating bristle roller, the longitudinal extent of which essentially is oriented horizontally to a floor to be cleaned. The second floor treatment apparatus 2 is likewise equipped with a communication module 4 in the form of a WLAN module in order to receive the information from the first floor treatment apparatus 1. The second floor treatment apparatus 2 furthermore has an evaluation device 8 that is designed for evaluating the information received from the first floor treatment apparatus 1 and for utilizing this information for a floor treatment. In order to enable the second floor treatment apparatus 2 to automatically travel within the environment, it is equipped with a navigation device with a laser scanner 19 that preferably can detect distances from obstacles 14 and boundaries of the rooms of a residence over an angular range of 360°. The evaluation device 8 of the floor treatment apparatus 2 processes this distance data into an environment map 9, an example of which is illustrated in FIG. 5, wherein said environment map contains a floor plan of the environment, the locations of obstacles 14, the position of the base station 16 and the like. The environment map 9 serves for the navigation and self-localization of the second floor treatment apparatus 2 within the environment. For example, the floor treatment apparatus 2 may utilize a so-called SLAM algorithm (Simultaneous Localization And Measurement algorithm) for generating the environment map 9.

Figure 4:
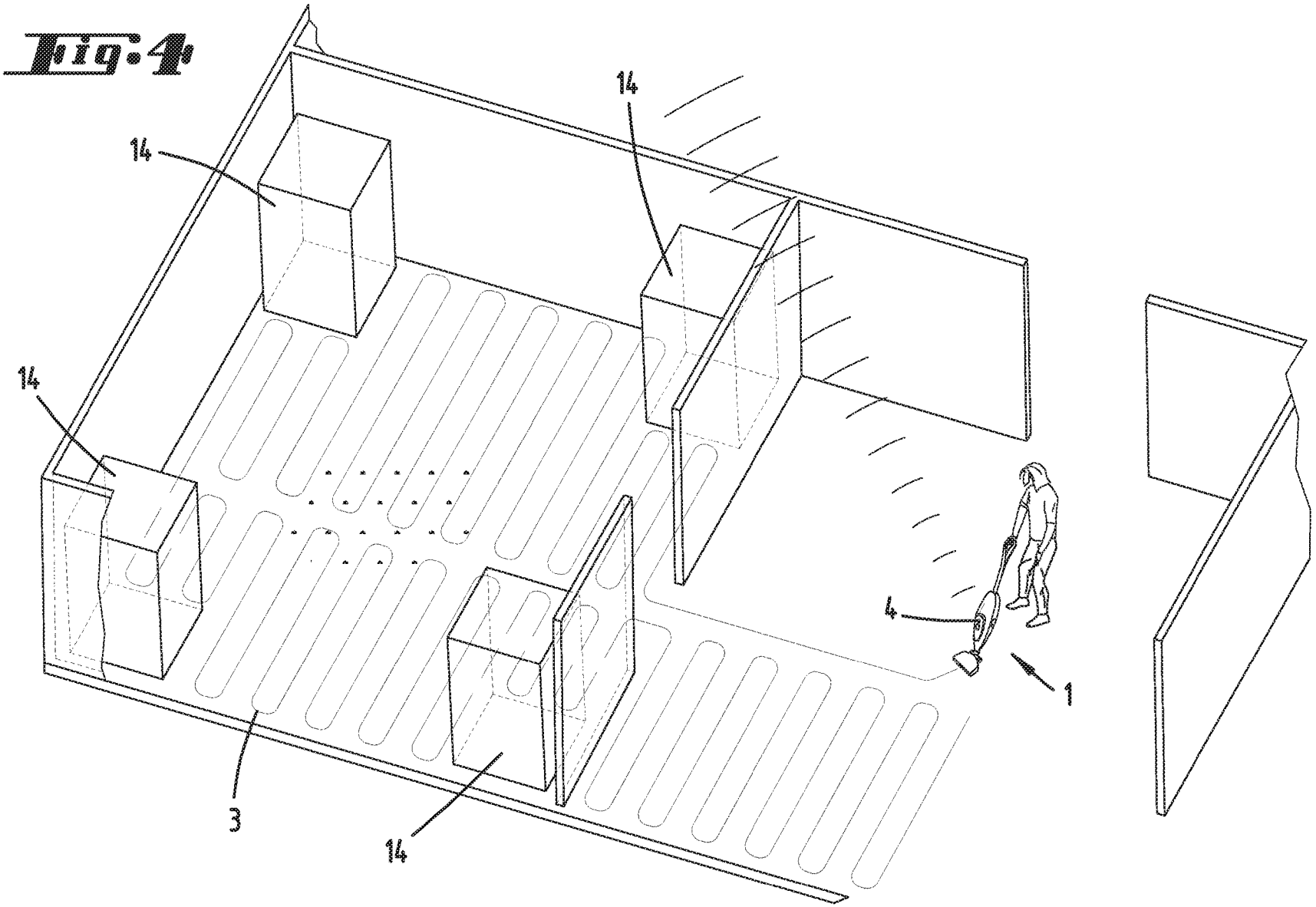
FIG. 4 shows a section of the environment with a movement path of the first floor treatment apparatus.
Figure 6:
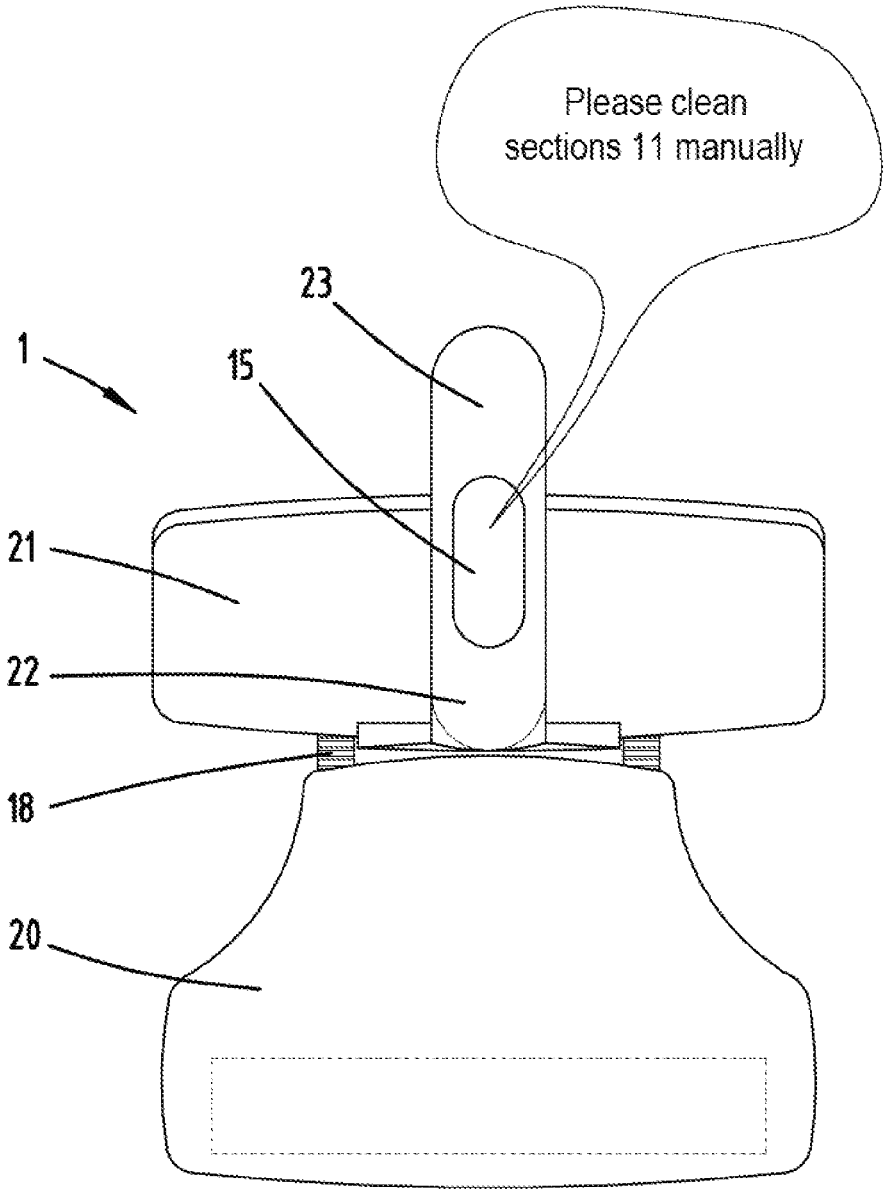
FIG. 6 shows the first floor treatment apparatus with a display unit for displaying information.

The invention is now described in greater detail with reference to FIGS. 4-6. The following explanations are merely examples for the utilization of an inventive system. It goes without saying that the floor treatment apparatuses 1, 2 may also be realized differently, i.e. they do not necessarily have to be vacuuming apparatuses, but rather may, for example, also be mopping apparatuses, polishing apparatuses or the like. In addition to the floor treatment apparatuses 1, 2 shown, the system may also comprise a plurality of other floor treatment apparatuses 1, 2 or different apparatuses such as service robots, monitoring robots or the like, which do not carry out any floor treatment activities.

The inventive method is carried out, for example, in that the user manually guides the first floor treatment apparatus 1 over a floor surface of the environment to be cleaned. In the process, the user moves the floor treatment apparatus 1 within a room of the residence illustrated in FIG. 4 and, for example, carries out meander-shaped movements that define a movement path 3 of the first floor treatment apparatus 1. The user guides the floor treatment apparatus 1 in such a way that sections 11 (see FIG. 5) of the environment are omitted, wherein said sections contain obstacles 14 that the floor treatment apparatus 1 should not touch because they have sensitive surfaces, may fall over or the like. The detection devices 5 and 6 of the floor treatment apparatus 1, namely the camera and the inertial sensor, record the movement path 3 of the floor treatment apparatus 1 and transmit this movement path to the computing device 24, which subsequently sends a message to the second floor treatment apparatus 2 by means of the communication module 4, wherein said message contains information on the movement path 3 followed by the user during the cleaning operation. The communication module 4 of the second floor treatment apparatus 2 receives this message and extracts the information in order to transfer the movement path 3 contained therein into an environment map 9, which already exists or still has to be generated by the floor treatment apparatus 2. The control and evaluation device 8 of the second floor treatment apparatus 2 uses the movement path 3 as a basis for generating a control command that steers the second floor treatment apparatus 2 through the environment along an identical or similar movement path 3. This movement path likewise omits the sections 11 of the environment that were avoided by the user. In this example, the first floor treatment apparatus 1 furthermore transmits additional information on a section 12 (see FIG. 5) of the environment with a particularly stubborn dirt accumulation, which the user was unable to remove with a single pass of the floor treatment apparatus 1 and requires intensive cleaning by means of the second floor treatment apparatus 2. The message sent by the first floor treatment apparatus 1 may furthermore contain information on the type of floor treatment activity of the first floor treatment apparatus 1, as well as on special parameters and adjustments of the floor treatment apparatus 1 such as a suction power stage used by the first floor treatment apparatus 1, a floor nozzle 20 used, a floor treatment element 17 used, a moving speed of the floor treatment apparatus 1 over the surface to be cleaned along the movement path 3 and the like. Furthermore, the detection results of the detection devices 5, 6, 7 of the first floor treatment apparatus 1 may also be transmitted to the second floor treatment apparatus 2 and include, for example, a treatment status 10 (dirty/clean) of a section 11, 12 of the environment, a position of a treated section 11, 12, an untreated section and/or a section, in which the first floor treatment apparatus 1 is not allowed to travel, a detected floor type, a type of dirt accumulation, a degree of dirt accumulation or the like. It goes without saying that the first floor treatment apparatus 1 may furthermore comprise other detection devices 5, 6, 7 such as a laser scanner 19, a floor sensor for detecting a type of surface to be treated, a dirt sensor for detecting a type or a degree of dirt accumulation, a sensor for determining the power of a driving motor, a distance sensor and/or a time sensor that provides information on the moving speed of the floor treatment apparatus 1. The message for the second floor treatment apparatus 1 may furthermore contain information on marked sections 11, 12 of the environment that require special floor treatment. To this end, the user can actuate the actuation element 13 on the handle 23 of the floor treatment apparatus 1, e.g. while passing over the severely soiled section 12, in order to mark a segment of the movement path 3, over which the floor treatment apparatus has traveled between a depression and a release of the actuation element 13. This segment of the movement path 3 or the associated section 12 can then be highlighted in the environment map 9. For example, the user may be additionally prompted to define a special floor cleaning activity for this section 12 such as spot cleaning, i.e. intensive cleaning. The control and evaluation device 8 of the second floor treatment apparatus 2 can then correspondingly control the second floor treatment apparatus 2 in such a way that a defined floor treatment activity is carried out within the marked section 12. It is likewise possible to define sections 11, in which the second floor treatment apparatus 2 is not allowed to travel, as so-called no-go areas for the second floor treatment apparatus 2. According to FIG. 5, the environment map 9 used by the second floor treatment apparatus 2 for navigation and floor treatment purposes then contains a variety of information, namely the treatment status 10 of certain sections of the environment such as an exemplary hatching for "not yet cleaned," information on the positions of sections 11, in which the second floor treatment apparatus 2 is not allowed to travel, information on sections 12 that require special floor treatment, e.g. intensive cleaning, as well as the conventional room boundaries and positions of obstacles 14 within the environment. Furthermore, the movement path 3 corresponding to the movement path 3 of the manually guided first floor treatment apparatus 1 is also plotted in the environment map 9.

After the environment has been cleaned by means of the automatically operated second floor treatment apparatus 2 in accordance with the generated environment map 9, the second floor treatment apparatus 2 can once again transmit information to the manually guided first floor treatment apparatus 1. It is particularly possible to transmit a supplemented environment map 9, which preferably also contains the updated treatment status 10 of the individual sections of the environment. For example, the environment map 9 can be displayed to a user on the display unit 15 of the manually guided floor treatment apparatus 1. It is alternatively and/or additionally also possible to display a cleaning request such as "please clean sections 11 manually" to the user as illustrated in FIG. 6. It is therefore possible to inform the user of the respective location in the environment, in which manual secondary cleaning should still be carried out due to a severe or stubborn dirt accumulation. A request may furthermore also concern sections 11 that contain removable objects such as vases or flower pots, which can be removed by a user in order to also allow cleaning in these sections. The user can decide and/or confirm if the aforementioned sections 11, 12 are manually cleaned by the user with the first floor treatment apparatus 1 or if these sections should be cleaned automatically by the second floor treatment apparatus 2, optionally with an input via a display unit 15 in the form of a touchscreen. As an alternative to displaying information on a display unit 15 of the floor treatment apparatus 1, a user can also receive corresponding information, for example, on a mobile external device with a corresponding application. During a subsequent manual floor treatment by means of the manually guided first floor treatment apparatus 1, the user can be guided to a particularly soiled location, for example, by direction or position indicators on the first floor treatment apparatus 1, by a projection onto the floor surface or by a display on an application. After the cleaning operation has been carried out, the user confirms the completed secondary cleaning on the floor treatment apparatus 1 or within the application. When an automatically operated second floor treatment apparatus 2 subsequently travels over this location again, it can optionally check if this location is still soiled and accordingly carry out another cleaning operation. It would also be conceivable that the manual cleaning step is omitted and the user instead confirms an intensive cleaning operation by means of the automatically operated second floor treatment apparatus 2.

One particular advantage of the utilization of a system consisting of a first floor treatment apparatus 1 that is exclusively guided manually by a user and a second floor treatment apparatus that is exclusively operated automatically can be seen in that the options, advantages and parameters of the differently designed floor treatment apparatuses 1, 2 can be used for advantageously supplementing one another. In this respect, a movement path or a floor treatment activity, which was previously carried out by means of the first floor treatment apparatus 1, can be advantageously modified by the second floor treatment apparatus 2 in order to utilize advantages of the second floor treatment apparatus 2 such as a smaller apparatus width, special floor treatment elements 17, a higher suction power or a mopping operation, which cannot be realized with the first floor treatment apparatus 1. The movement path 3 and the floor treatment activity of the second floor treatment apparatus 2 therefore can also advantageously differ from those of the first floor treatment apparatus 1.

LIST OF REFERENCE SYMBOLS

1 First floor treatment apparatus
2 Second floor treatment apparatus
3 Movement path
4 Communication module
5 Detection device
6 Detection device
7 Detection device
8 Evaluation device
9 Environment map
10 Treatment status
11 Section
12 Section
13 Actuation element
14 Obstacle
15 Display unit
16 Base station
17 Floor treatment element
18 Wheel
19 Laser scanner
20 Floor nozzle
21 Base unit
22 Shaft
23 Handle
24 Computing device

The invention claimed is:

1. A system consisting of a first floor treatment apparatus (1) in a form of a first floor cleaning apparatus that is exclusively guided manually within an environment by a user and a second floor treatment apparatus (2) in a form of a second floor cleaning apparatus that is exclusively operated automatically, wherein the second floor treatment apparatus (2) is designed for orienting and localizing itself within the environment, wherein the first floor treatment apparatus (1) is designed for detecting a movement path (3) of the first floor treatment apparatus (1) during a movement of the first floor treatment apparatus (1) that is manually guided by the user, as well as for transmitting information on the detected movement path (3) to the second floor treatment apparatus (2) by means of wireless communication, wherein the second floor treatment apparatus (2) is designed for receiving the information and for autonomously traveling along the movement path (3) within the environment based on the received information.

2. The system according to claim 1, wherein the first floor treatment apparatus (1) is designed for detecting a floor treatment activity in a form of a cleaning activity carried out by the first floor treatment apparatus (1) during a user-guided movement of the first floor treatment apparatus (1), as well as for transmitting information on the floor treatment activity to the second floor treatment apparatus (2) by means of wireless communication, wherein the second floor treatment apparatus (2) is designed for receiving the information and for automatically carrying out the floor treatment activity.

3. The system according to claim 2, wherein the first floor treatment apparatus (1) and the second floor treatment apparatus (2) have corresponding communication modules (4) for wireless communication of the information on the movement path (3) and/or the floor treatment activity.

4. The system according to claim 1, wherein the first floor treatment apparatus (1) has a detection device (5, 6, 7) selected from the following group: camera, laser scanner (19), floor sensor for detecting a type of surface to be treated, dirt sensor for detecting a type or degree of a dirt accumulation on the surface to be treated, sensor for determining a power of a driving motor, distance sensor, inertial sensor, time sensor and contact sensor.

5. The system according to claim 4, wherein the first floor treatment apparatus (1) and/or the second floor treatment apparatus (2) has an evaluation device (8) that is designed for determining at least one of the following types of information from detection signals of the detection device (5, 6, 7): the movement path (3) of the first floor treatment apparatus (1) in the environment, an environment map (9), a treatment status (10) of a section (11, 12) of the environment, a position of a treated section (11, 12), an untreated section and/or a section that is not accessible to the first floor treatment apparatus (1), the floor type, the type of dirt accumulation, the degree of dirt accumulation, an accessory suitable for use by the first floor treatment apparatus (1) for floor treatment purposes, 3D environment information and obstacle information.

6. The system according to claim 1, wherein the first floor treatment apparatus (1) has an actuation element (13) that can be actuated by the user and enables the user to mark sections (11, 12) of the environment stored in an environment map (9) and/or positions of the movement path (3) during a movement of the first floor treatment apparatus (1) and/or during a floor treatment activity.

7. The system according to claim 6, wherein the first floor treatment apparatus (1) is designed for transmitting information on the marked sections (11, 12) and/or positions to the second floor treatment apparatus (2), wherein the second floor treatment apparatus (2) has a control and evaluation device (8) that is designed for controlling a defined floor treatment activity of the second floor treatment apparatus (2) within the marked sections (11, 12) or at the marked position or for avoiding the marked sections (11, 12) or the position as a no-go area during the floor treatment activity.

8. The system according to claim 7, wherein the floor treatment activity of the second floor treatment apparatus (2) defined for the marked sections (11, 12) or the marked position differs from the floor treatment activity carried out by the first floor treatment apparatus (1) in the marked sections (11, 12) or at the marked position.

9. The system according to claim 7, wherein the defined floor treatment activity of the second floor treatment apparatus (2) comprises intensive cleaning or gentle cleaning of the marked sections (11, 12) or the marked position.

10. The system according to claim 1, wherein the second floor treatment apparatus (2) is designed for transmitting information concerning the environment to the first floor treatment apparatus (1) after the second floor treatment apparatus has traveled along the movement path (3) and/or after the second floor treatment apparatus has carried out the floor treatment activity, wherein said information is selected from the following group: an environment map (9) of the environment generated by the second floor treatment apparatus (2), a section (11, 12) of the environment and/or a position of the movement path (3) to be cleaned manually by the first floor treatment apparatus (1) and a section (11, 12) or position that contains a movable obstacle (14) to be removed by the user.

11. The system according to claim 10, wherein the first floor treatment apparatus (1) has a display unit (15) for displaying the information transmitted by the second floor treatment apparatus (2).

12. A method for operating the system according to claim 1, wherein the first floor treatment apparatus (1) is exclusively guided manually within an environment by the user, wherein the second floor treatment apparatus (2) is exclusively operated automatically, and wherein the second floor treatment apparatus (2) orients and localizes itself within the environment, wherein the first floor treatment apparatus (1) detects the movement path (3) of the first floor treatment apparatus (1) during the movement of the first floor treatment apparatus (1) that is manually guided by the user and transmits information on the detected movement path (3) to the second floor treatment apparatus (2) by means of wireless communication, wherein the second floor treatment apparatus (2) receives the information and autonomously travels along the movement path (3) within the environment based on the received information, and/or wherein the first floor treatment apparatus (1) detects a floor treatment activity carried out by the first floor treatment apparatus (1) during the movement of the first floor treatment apparatus and transmits information on the floor treatment activity to the second floor treatment apparatus (2) by means of wireless communication, wherein the second floor treatment apparatus (2) receives the information and automatically carries out the floor treatment activity.

* * * * *